United States Patent [19]

Ganholt

[11] 4,094,121

[45] June 13, 1978

[54] METHOD AND APPARATUS FOR PACKING PRODUCTS IN SUBSTANTIALLY OXYGEN FREE ATMOSPHERE

[75] Inventor: Bo Olov Ganholt, Vallingby, Sweden

[73] Assignee: Esseltepac Aktiebolag, Jarfalla, Sweden

[21] Appl. No.: 750,397

[22] Filed: Dec. 14, 1976

[30] Foreign Application Priority Data

Dec. 12, 1975 Sweden ..... 7514648

[51] Int. Cl.[2] ..... B65B 31/00

[52] U.S. Cl. ..... 53/22 R; 53/88; 53/112 R

[58] Field of Search ..... 53/22 R, 22 B, 88, 112 R, 53/112 B

[56] References Cited

U.S. PATENT DOCUMENTS 1,886,376 11/1932 Dambacher ..... 53/385

3,871,157 3/1975 Domke et al. ..... 53/112 B X

*Primary Examiner*—Travis S. McGehee

*Attorney, Agent, or Firm*—Larson, Taylor and Hinds

[57] ABSTRACT

A method and apparatus are provided for packing products in bottom closed containers of cardboard, plastic, glass or the like, without vacuum suction or compression and in a substantially oxygen free atmosphere. A bottom closed container is mounted in a substantially air tight condition on a holder funnel and thereafter a piston in sealed engagement with the inner sides of the container is forced down through the container to the bottom thereof so that the air which is present in the container is forced up to the upper side of the piston. The piston is then withdrawn from the container to thereby exhaust the air which is present above the piston. A protective gas is introduced simultaneously with the withdrawal of the piston at a location underneath the piston and without subjecting the interior of the container to the influence of air as the container is filled with the product to be packed. The filled container is transfered to a station sealing and closing.

12 Claims, 4 Drawing Figures

METHOD AND APPARATUS FOR PACKING PRODUCTS IN SUBSTANTIALLY OXYGEN FREE ATMOSPHERE

The invention relates to a method and an apparatus for packing products in substantially oxygen free atmosphere, and the invention is especially concerned with packing of products in containers of cardboard or similar stiff material without compressing, vacuum sucking or similar methods providing a compressing of the packed product.

Many products are adversely affected by the oxygen of the air, and this is for instance the case with certain types of foodstuffs, products containing fat substances etc. Previously such products often were packed so that the air of the container was evacuated by vacuum sucking, whereupon, where suitable, a portion of the evacuated air was replaced by some inert gas. Many products are also adversely affected by the high pressures during the vacuum sucking since the products can be crushed or the product can be so strongly compacted that the solubility of mixability thereof is reduced.

It has previously been proposed that such products should be packed by being fed into bags of soft material in counter current to an inert gas, which gas is preferably allowed to flow through said bag thereby forcing out the air, whereupon the bag with its content of product to be packed and inert gas is sealed. The said method is however not suitable for containers of cardboard or similar stiff material which, prior to the filling thereof with the product, have to be closed at the container bottom. For such containers attempts have been made to replace the air in the container with an inert gas by washing the interior of said container with such gas. A washing out of the air inside the container is accomplish by mixing the air with the inert gas and successively reducing the amount of air in the mixture, however, this consumes a large amount of the inert gas which is often expensive, and depending on the amount of consumption of inert gas, the said method of packing products is relatively expensive.

The object of the invention therefore is to solve the problem of providing a method and an apparatus for packing products in containers of carboard or similar stiff material in a substantially oxygen free atmosphere without compressing the products to be packed, so that a relatively soft ready packed container containing the product and the inert gas is obtained. According to the invention the container is closed at the bottom before being filled with the product, and the container is connected substantially air tightly to the filling funnel for the product, the air of the container is expelled by moving a piston down into the container, the container is filled with inert gas at the same time as the piston is drawn out of the container, and the product to be packed is poured down into the container in counter current to the ascending inert gas, and finally the container is sealed without allowing any substantial amount of air penetrate into the container.

Further characteristics of the invention will be evident from the following detailed description in which reference will be made to the accompanying drawings. It is however to be understood that the method and the apparatus thus described and shown in the drawings are only illustrating examples and that the invention is only defined by the appended claims.

In the drawings FIG. 1 diagrammatically and in a perspective view shows an apparatus for executing the method according to the invention.

Figure 1:
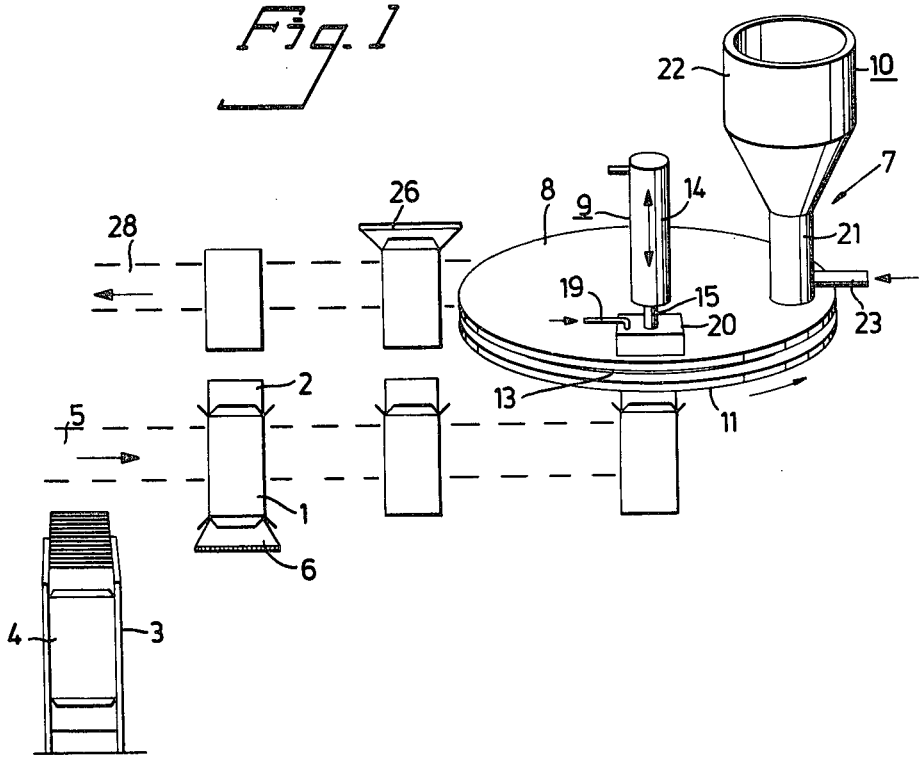

As mentioned above the object of the invention is to provide a method and an apparatus for filling and sealing, in a substantially oxygen free atmosphere, a container which is closed at the bottom, for instance a container of the type which is illustrated in the drawings. The container is formed with an outer casing 1 of cardboard or similar stiff material and an inner liquid and gas tight lining 2 of a thin and easily foldable material. The container may however by any other kind of container such as an unlined gas tight container of cardboard, plastic or similar material, a bottom closed tin pot, a glass jar or similar. What is important to the invention is that the bottom closed container is emptied of air, whereupon it is filled with an inert gas, the said gas filled container is filled with the product to be packed and is closed without allowing air to enter the container. According to the invention the container, the means for exhausting the air thereof, the means for filling the container with a protective gas, the means for filling the container with the product to be packed and the means for commencing the sealing of the container form a closed, substantially air tight unit in which the container is treated in several operation stages.

The apparatus which is diagrammatically illustrated in the drawings comprises a magazine 3 for a number of completely collapsed containers 4 which are successively fed onto a conveyer 5, on which the containers are successively seized, opened to tubular form and closed at the bottom 6, whereupon the bottom closed container is moved to a filling station 7. The said filling station 7 comprises an upper fixed disc 8 of circular or other form in which means 9 are mounted for exhausting the air of the bottom closed container and filling same with a protective inert gas, and in which means 10 are also mounted for filling the container with the product to be packed. Underneath the fixed disc 8 a moveable disc or carousel 11 is mounted and at the underside thereof one or several means 12 for holding a container is mounted. The moveable disc 11 is roteatable about a vertical shaft extending centrally in relation to the gas washing means 9 and the filling means 10. Between the fixed disc 8 and the moveable disc 11 there is a sealing means 13 providing a gas tight connection of the two discs 8 and 11.

The gas washing means 9 comprises a vertically mounted pneumatically or hydraulically actuated cylinder 14 which, with its piston rod 15, extends down through the fixed disc 8 and which can be moved through suitable holes 16 of the moveable disc 11. At the lower end the piston rod 15 carries a piston 17 which may be formed with one or several valves 18 and connection conduits 19 for a protective inert gas. The piston 17 is of the same form and size as the cross sectional area of the container to be filled, and in order to provide a good sealing between the piston 17 and the container 4 the piston can also be formed with sealings extending thereabout. The valve 18 is preferably single acting and opens in the direction upwards so that the air which by the piston 17 is forced to the upper side of the piston is prevented to flow back into the container as the piston is withdrawn from the container. The gas in the conduit 19 preferably has some overpressure so that the inner of the container is automatically filled with gas as soon as the piston 17 is withdrawn from the container. In an alternative embodiment of the invention the piston 17 may at the upper side and/or the underside have a rubber membrane contacting the inside of the container lining thereby providing a valve for letting the air out of the container.

In order that the piston 17 shall not prevent the rotation of the carousel 11 a sealed housing 20 is provided at the upper side of the fixed disc 8 in which housing the piston 17 is located when moved up from the container so as to allow free rotation of the carousel 11.

The filling means 10 comprises a filling tube 21 which may contain a dosage means for volumetric or weight measuring of dosages of the product to be packed and the said filling tube 21 is connected to a filling funnel 22 into which the product is fed. The product to be packed may be flakes, corns, powder, granulate or other material, and the method according to the invention is especially suited for packing of such products which are damaged, deteriorated or otherwise adversely affected by the influence of the oxygen of the air and by such conventional packing in which the product is compressed or compacted. The filling tube 21 is air tightly mounted on the upper side of the fixed disc 8, and adjacent the lower end of the tube 21 there is an inlet 23 for the protective inert gas which can be forced upwards through the filling tube 21 and the filling funnel 21 so as to flush or wash clean from air the goods to be packed.

At the underside the moveable disc or carousel 11 is formed with one or more holder means 12 for containers, and each such holder means comprises a funnel 24 which is slightly conical at least in the area where the piston enters the container, and the said funnel 24 can be introduced into the mouth of the lining 2 so as to provide a sealing between the container lining 2 and the carousel 11. The funnel 24 and the corresponding hole 16 in the carousel is of a form and size corresponding to the inner surface of the container and the outer surface of the gas exhaust piston 17, so that the air of a container present on the funnel 24 can be exhausted, the container can be filled with gas, filled with the product to be packed and be completely or partly sealed while still being present on the said funnel 24.

Figure 2:
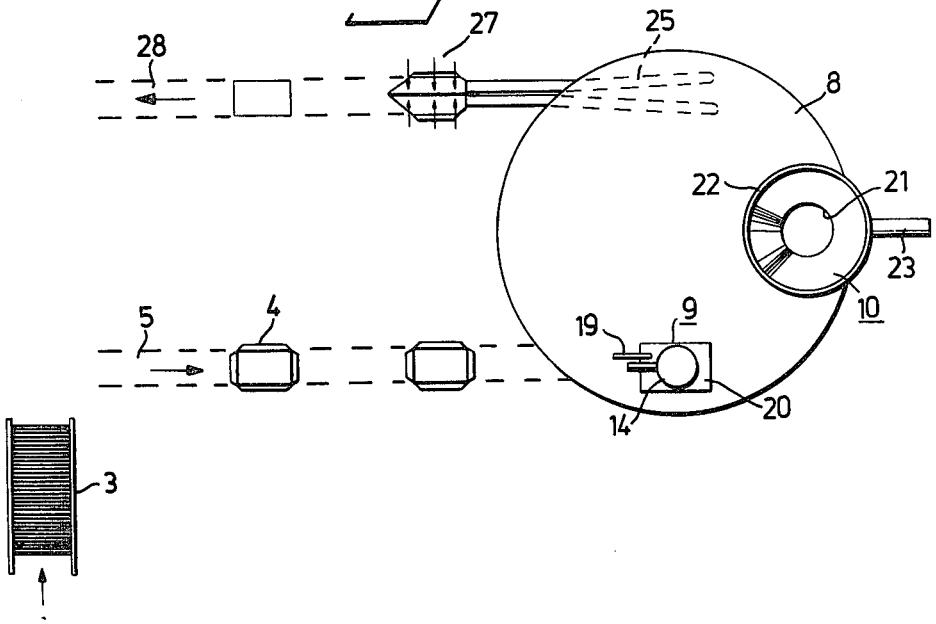
FIG. 2 shows the apparatus according to FIG. 1 from above.
Figure 3:
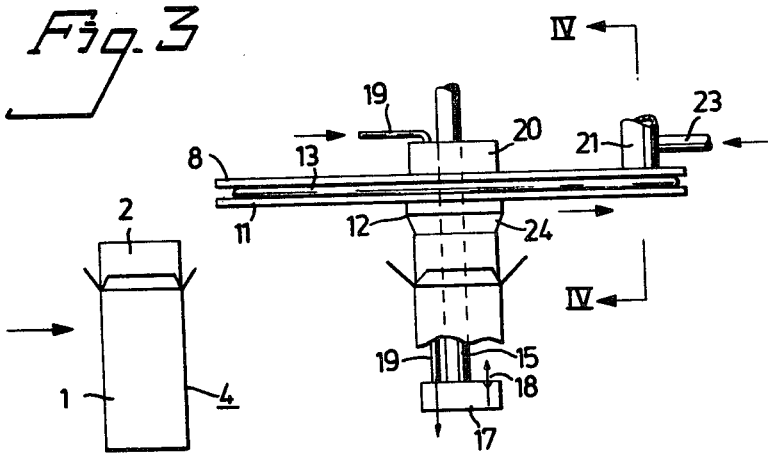
FIG. 3 is a side view showing some parts of the apparatus according to FIGS. 1 and 2 more in detail.
Figure 4:
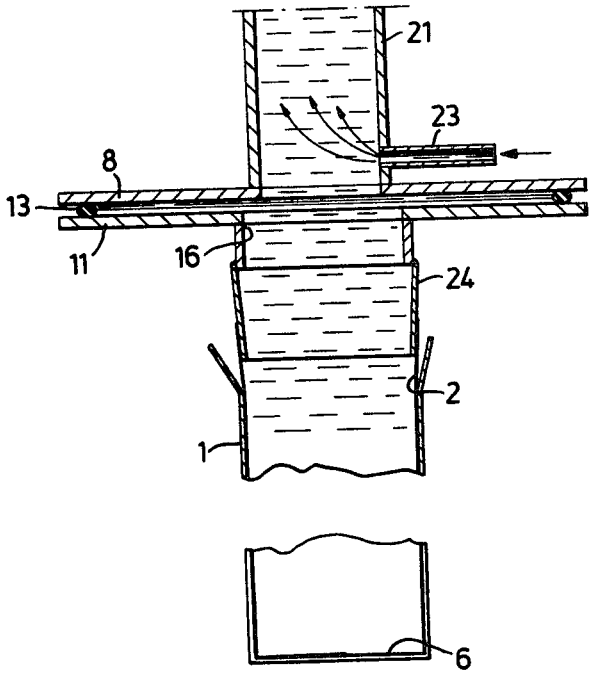
FIG. 4 shows a detail of the apparatus according to the invention seen along line IV—IV of FIG. 3.

For commencing the sealing of the container, means are provided on the machine base for squeezing up the mouth of the container lining while expelling at the same time some excess of protective gas. The said means may be two obliquely extending bars 25 engaging the container lining just below the funnel 24 and which as the container is moved along the said bars bring the upper edge 26 of the lining to a canister form as indicated in FIGS. 1 and 2, whereupon the lining can easily be heat sealed, welded, glued together or closed in any other suitable way. In FIG. 2 the arrows 27 indicate a sealing of the lining by means of welding.

The method according to the invention is accomplished as follows: From the magazine 3 a completely collapsed container blank is taken out and the said blank is moved to the conveyor 5 and is opened to tubular form in a first stage. The container is sealed and closed at the bottom 6 and is thereafter, by the conveyor 5, transferred to the holder means 12 at the underside of the rotateable carousel 11. When the container is received on the funnel 24 of the said holder means and is located in position under the gas washing means 9 the piston 17 thereof is pushed down into the inner of the container until it contacts the bottom thereof, whereafter it is withdrawn. At the same time the air which is present at the upper side of the piston 17 is forced up and out of the container and the space at the underside of the piston is filled with a protective gas which should be an inert gas like for instance nitrogen dioxide, carbon dioxide or the like. When the piston has been drawn up to be present in the piston housing 20 the carousel 11 rotates to a filling position in which the container is present under the filling means 10, whereby a previously measured or weighed out amount of the product to be packed is let down into the container. This may be accomplished in that a valve disc or similar (not shown in the drawings) at the bottom of the filling tube 21 is opened, and after the measured or weighed out amount is let out of the filling tube, the said valve disc is closed.

Thereupon the carousel rotates further some distance in the counter clockwise direction, whereby the filled container which is still held at the holder funnel 24 is moved to the area between the closing bars 25 so that said bars squeeze up the lining on line with the upper edge of the outer casing 1 at the same time as excess of gas is expelled from the container. Then the container is released from the holder funnel 24 either by lowering the container or by raising the holder funnel 24, and the container is seized by a second conveyor 28 and is sealed by the welding means 28 or in any other way and is moved on for distribution or storing. Since the exhausting of air in the container, the filling thereof with a protective gas, the filling of the container with the product to be packed and at least the commencing of the sealing is accomplished in a closed system without admission of air and without compressing or compacting of the product to be packed, it is possible by the above described method to pack practically any kinds of products in a substantially completely oxygen free atmosphere whether the said products are fragile, tend to get caked or run the risk of otherwise being adversely affected when being packed by conventional methods. With the method according to the invention practically any kind of bottom closed containers can be used whether they are made of relatively soft material like cardboard, paper, plastic or the like or they are made of hard materials like tin, glass or the like. It is obvious that the sealing of tin pots or glass jars are made in a somewhat different way, and in the latter case a lid can easily be pushed over the upper edge of the container at the same time as the holder funnel 24 is removed from the container. Depending on the slight overpressure of gas in the container the said step can be accomplished without letting practically any air into the container even if the holder funnel is removed from the container before the lid is mounted thereon.

What we claim is:

1. A method of packing products, without vacuum suction or compression and in a substantially oxygen free atmosphere, in bottom closed containers of cardboard, plastic, glass, tin or the like, said method comprising mounting a bottom-closed container in a substantially air tight condition on a holder funnel; forcing a piston in sealed engagement with the inner sides of the container down through the container to the bottom thereof so that air which is present in the container is forced up to the upper side of the piston; withdrawing the piston from the container to thereby exhaust the air which is present above the piston; introducing a protective gas underneath the piston simultaneously with the withdrawal of the piston and without subjecting the interior of the container to the influence of air as the container is filled with the product to be packed; and thereafter transfering the container to a station for sealing and closing the container after the same is filled with the product and the protective gas, said container being maintained under substantially air tight conditions by the holder funnel during the entire filling operation and during at least an initial portion of the sealing operation.

2. Method according to claim 1 for packing a product in a container comprising an outer casing of cardboard or a similarly stiff material and an inner lining of a thin and easily foldable material, said method further comprising applying the holder funnel to the interior of the liner to thereby slightly expand the same, and sealing the lining by pressing the sides of the lining together below the lower edge of the holder funnel.

3. Method according to claim 1, characterized in that the exhausting of air from the container and the filling thereof with protective gas is performed in a common step.

4. Method according to claim 1 characterized in that the station for filling of the container with protective gas is located adjacent to the station for filling of the container with the intended product, whereby the container after having been filled with gas is transferred to the station for filling the same with the product under conditions without the admittance of air.

5. Method according to claim 1, characterized in that the product to be packed is washed with a protective gas before the product is let down into the container filled with the protective gas.

6. Method according to claim 2, characterized in that the container lining is sealed immediately following the pressing together of the sides of the lining.

7. An apparatus for packing products in bottom closed containers of cardboard, plastic, glass, tin or the like, without vacuum suction or compression and in a substantially oxygen free atmosphere, said apparatus comprising a holder funnel for mounting the bottom-closed container in a substantially air tight manner, means fixedly located at a first station for mechanically exhausting the air in the container, means for filling the container with an inert gas simultaneously with the exhausting of the container, means fixedly located at a further station for filling the container with product without admitting air to the interior of the container, and means for sealing the container without the emission of air to the container at least during an initial stage of the sealing operation, said device further comprising means for mounting said holder funnel for movement between different said stations under air sealed conditions.

8. Apparatus according to claim 7 wherein said means for exhausting the air in the container and said means for filling the container with an inert gas comprise piston means, sealingly engaging the inner sides of the container and moveable between an extended position wherein the piston is disposed at the bottom of the container and a withdrawn position removed from said container, for forcing air to the upper side of the piston means when said piston means is moved down into the container to the first position thereof and for exhausting air which is present above the piston means when said piston means is moved to the withdrawn position thereof, said piston means comprising a piston including at least one single acting valve for passing air to the upper side of the piston and connection means, extending through said piston, for filling the container with the protective gas as the piston is moved up and out of the container.

9. Apparatus according to claim 8 characterized in that the air exhausting and gas filling means and the product filling means are mounted on a fixed disc and wherein said holder funnel is mounted on a rotatable carousel and rotatably connected in air sealed relationship to the fixed disc.

10. Apparatus according to claim 9, characterized in that said mechanical exhausting means includes an air exhausting piston, said fixed disc includes a housing for receiving the air exhausting piston when said piston is moved to an inoperable position relative to said rotatable carousel to allow said carousel to be rotated to a subsequent working station.

11. Apparatus according to claim 7, characterized in that the product filling means comprises a filling tube including means for measuring and weighing out a predetermined amount of the product to be packed, a filling funnel connected to the said filling tube and means for providing a flow of protective gas in an upwardly direction through the product to be filled.

12. Apparatus according to claim 7 characterized in that the sealing means comprises two obliquely extending bars for engaging the upper end of the container lining in a position below the filling funnel and for squeezing the said container lining while simultaneously expelling the excess gas from the container.

* * * * *